US008936415B2

(12) United States Patent
Lugg et al.

(10) Patent No.: US 8,936,415 B2
(45) Date of Patent: Jan. 20, 2015

(54) ROOF SUPPORT SHEET HANDLING FOR UNDERGROUND MINES

(75) Inventors: Peter A. Lugg, Ferny Grove (AU); Richard D. Boyd, Balgownie (AU); Adrian Germyn, Narellan Vale (AU); William D. Eddowes, Bowral (AU); Chris Coates, Samford (AU)

(73) Assignee: Joy MM Delaware, Inc., Wilmington, DE (US)

( * ) Notice: Subject to any disclaimer, the term of this patent is extended or adjusted under 35 U.S.C. 154(b) by 16 days.

(21) Appl. No.: 13/399,495

(22) Filed: Feb. 17, 2012

(65) Prior Publication Data

US 2012/0213598 A1 Aug. 23, 2012

Related U.S. Application Data

(60) Provisional application No. 61/444,599, filed on Feb. 18, 2011.

(51) Int. Cl.
*E21C 27/24* (2006.01)
*E21D 11/40* (2006.01)
(Continued)

(52) U.S. Cl.
CPC ..... *E21D 11/403* (2013.01); *E21D 20/003* (2013.01); *E21D 11/152* (2013.01); *E21C 27/24* (2013.01)
USPC ..... 405/290; 405/272; 405/288; 405/302.1; 405/302.3; 299/1.3; 299/11; 299/12; 299/33

(58) Field of Classification Search
CPC ..... E21C 27/24; E21D 20/003; E21D 11/152; E21D 11/403
USPC ..... 405/272, 288, 290, 300, 302.1, 302.3, 405/302.7; 299/1.3, 1.7, 11, 12, 18, 19, 33; 414/10–12, 222.01; 226/6, 76, 86; 269/289 MR, 32
See application file for complete search history.

(56) References Cited

U.S. PATENT DOCUMENTS 4,101,173 A * 7/1978 Hodgkinson ..... 299/33
4,122,682 A 10/1978 Groetschel
(Continued)

FOREIGN PATENT DOCUMENTS

AU 674260 12/1996
AU 740995 11/2001
(Continued)

OTHER PUBLICATIONS

First Office Action from the Australian Intellectual Property Office Application No. 2012200938 dated Mar. 31, 2014 (4 pages).
(Continued)

*Primary Examiner* — Sunil Singh
*Assistant Examiner* — Carib Oquendo
(74) *Attorney, Agent, or Firm* — Michael Best & Friedrich LLP

(57) ABSTRACT

Systems for installing roof support sheets on a mine roof. One system includes a support frame, a lifting system, and a feeding system. The support frame holds a plurality of roof support sheets. The lifting system lifts at least one of the sheets from the support frame. The feeding system obtains the at least one sheet from the lifting system and feeds the at least one sheet toward an installation apparatus for installation on the mine roof. The lifting system includes a shoe and at least one arm for moving the shoe to engage and move the at least one sheet. The feeding system includes a drive assembly and a support. The drive assembly engages and moves the at least one sheet toward the installation apparatus, and the support supports the at least one sheet moved by the drive assembly.

18 Claims, 15 Drawing Sheets

(51) Int. Cl.
*E21D 20/00* (2006.01)
*E21D 11/15* (2006.01)

(56) References Cited

U.S. PATENT DOCUMENTS

| | | | | |
|---|---|---|---|---|
| 5,333,936 | A | 8/1994 | Zitz | |
| 5,816,750 | A * | 10/1998 | Steffenino | 405/302.3 |
| 6,428,109 | B1 | 8/2002 | Lerchbaum et al. | |
| 6,785,988 | B2 | 9/2004 | Lammer et al. | |
| 6,945,738 | B2 | 9/2005 | O'Quinn et al. | |
| 7,070,331 | B2 | 7/2006 | Schaffer et al. | |
| 7,316,456 | B2 | 1/2008 | Walker et al. | |
| 7,677,674 | B2 | 3/2010 | Brandl et al. | |
| 7,883,298 | B2 | 2/2011 | Brandl | |
| 8,137,033 | B1 * | 3/2012 | Hinshaw et al. | 405/302.3 |
| 2004/0177979 | A1 | 9/2004 | Rubie et al. | |
| 2005/0156460 | A1 | 7/2005 | Brandl | |
| 2009/0283228 | A1 | 11/2009 | Horsch | |

FOREIGN PATENT DOCUMENTS

| | | | |
|---|---|---|---|
| AU | 2010203314 | A1 | 2/2011 |
| WO | 2009006692 | A1 | 1/2009 |

OTHER PUBLICATIONS

Second Examination Report from the Intellectual Property Office of Australia for Application No. 2012200938 dated Aug. 29, 2014 (6 pages).

* cited by examiner

ROOF SUPPORT SHEET HANDLING FOR UNDERGROUND MINES

RELATED APPLICATIONS

This application claims priority to U.S. Provisional Application No. 61/444,599 filed Feb. 18, 2011, the entire contents of which are hereby incorporated by reference.

BACKGROUND

Embodiments of the invention relate to mesh handling systems for underground mines and bolting machines.

SUMMARY

Large roof support sheets (e.g., steel mesh sheets) are commonly bolted to the overhead surfaces of a mined tunnel (hereinafter referred to as "roofs") to increase personnel safety. The sheets, however, are unwieldy, which makes them difficult to move and position for bolting.

Therefore, embodiments of the invention provide systems for installing roof support sheets on a mine roof. One system includes a support frame, a lifting system, and a feeding system. The support frame holds a plurality of roof support sheets to be installed on a mine roof. The lifting system lifts at least one of the plurality of roof support sheets from the support frame. The feeding system obtains the at least one of the plurality of roof support sheets from the lifting system and feeding the at least one of the plurality of roof support sheets toward an installation apparatus for installation on the mine roof.

Another embodiment of the invention provides a lifting system for installing roof support sheets on a mine roof. The lifting system includes a shoe and at least one arm. The shoe engages a roof support sheet contained in a support frame. The at least one arm moves the shoe to engage the roof support sheet and, after the shoe is engaged with the roof support sheet, moves the roof support sheet toward an installation apparatus for installing the roof support sheet on the roof mine.

Yet another embodiment of the invention provides a feeding system for installing roof support sheets on a mine roof. The feeding system includes a drive assembly and a support. The drive assembly engages a roof support sheet and moves the roof support sheet toward an installation apparatus, and the support supports the roof support sheet moved by the drive assembly.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

Also, although directional references, such as upper, lower, downward, upward, rearward, bottom, front, rear, etc., may be made herein in describing the drawings, these references are made relative to the drawings (as normally viewed) for convenience. These directions are not intended to be taken literally or limit the present invention in any form. In addition, terms such as "first," "second," and "third" are used herein for purposes of description and are not intended to indicate or imply relative importance, significance, or ordering unless otherwise indicated.

Figure 1:
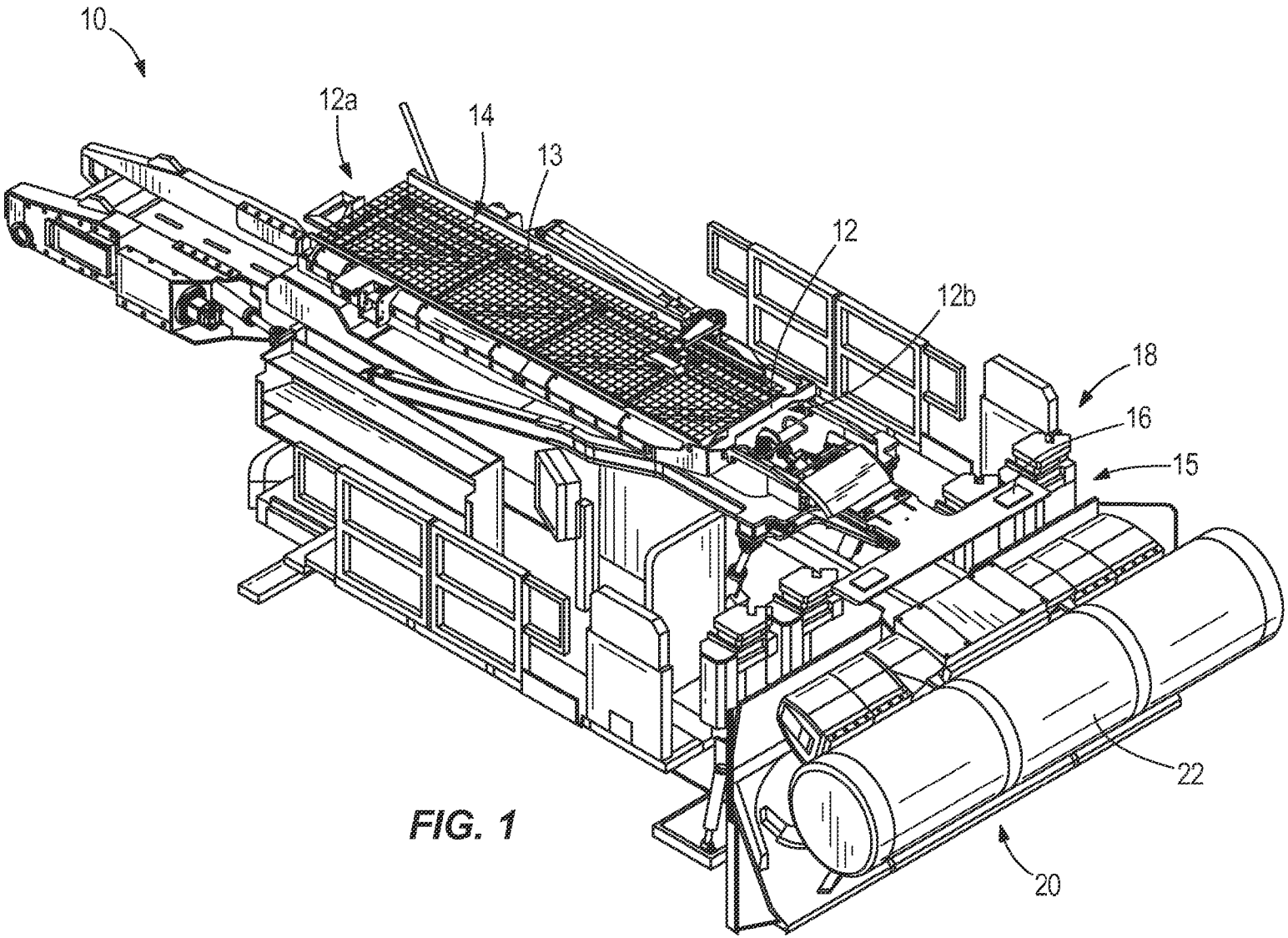
FIG. 1 is a perspective view of a bolting and mining machine according to one embodiment of the invention.

As described above, handling large roof support sheets in an underground mine can be a difficult process and, if performed incorrectly, can create safety concerns. Accordingly, embodiments of the invention provide systems and methods for lifting and conveying roof support sheets, such that they can be positioned for installation. FIG. 1 is a perspective view of a machine 10 according to one embodiment of the invention. As shown in FIG. 1, the machine 10 includes a support frame 12 that has a first end 12*a* and a second end 12*b*. The support frame 12 can be raised and lowered (e.g., using one or more hydraulic systems). The support frame 12 holds one or more roof support sheets 13. The roof support sheets 13 can include steel mesh sheets or can be constructed from another metal or another material capable of supporting a mine roof. In some embodiments, multiple sheets 13 (e.g., approximately 30 sheets) are formed into a pod 14 and placed within the support frame 12. The pod 14 can include a container (e.g., see FIG. 6*a*) that holds multiple sheets 13, which makes it easier to load sheets 13 into the support frame 12. As shown in FIG. 1, the sheets 13 can be positioned on the support frame 12 length-wise along the length of the machine 10 (e.g., parallel to the direction of travel of the machine 10 in a longitudinal position). Positioning the sheets 13 in this orientation keeps the width of the machine 10 reduced, which allows for easier maneuverability of the machine 10 in a mine.

Positioned in front of the second end 12*b* of the support frame 12 is installation apparatus 15 for positioning a sheet 13 on the mine roof and bolting the sheet 13 to the roof. The installation apparatus 15 can include a positioning frame or platform 16. The positioning frame 16 can have a "T-shape" and can hold one or more sheets 13 for installation on a mine roof. In particular, in some embodiments, the positioning frame 16 holds one sheet 13 at a time length-wise across the upper part of the "T-shape" (e.g., perpendicular to the direction of travel of the machine 10 in a transverse position), and the positioning frame 16 (or portions thereof) raises and lowers (e.g., using one or more hydraulic systems) the sheet 13 to position the sheet 13 along the mine roof. In some embodiments, the positioning frame 16 can also move forward and backward (e.g., parallel to the direction of travel of the machine 10) to properly position a sheet 13 along the mine roof. In some embodiments, the positioning frame 16 lifts and positions a new sheet 13 such that an edge of the new sheet 13 overlaps with the end of the previously-bolted sheet 13. As shown in FIG. 1, the installation apparatus 15 can also include one or more bolting mechanisms 18 that bolt a sheet 13 positioned by the positioning frame 16 to the mine roof.

Figure 2A:
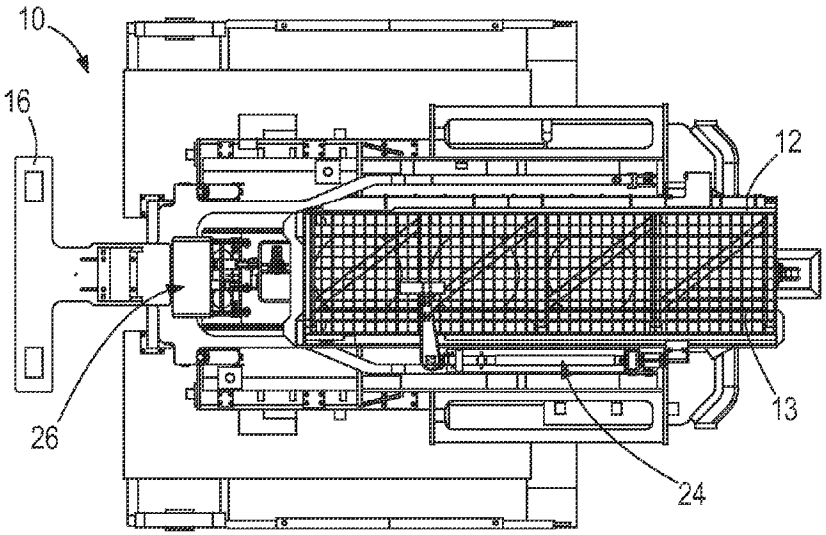
FIG. 2*a* is a top view of the bolting and mining machine of FIG. 1 illustrating a lifting system and a feeding system according to one embodiment of the invention.
Figure 2B:
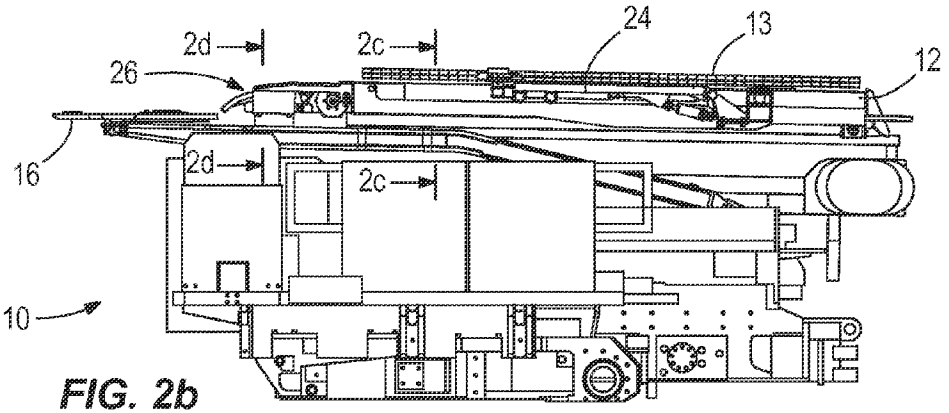
FIG. 2*b* is a side view of the lifting system and the feeding system of FIG. 2*a*.

In operation, a number of sheets 13 (or a pod 14) are stacked on the support frame 12. As shown in FIGS. 2*a*-*b*, a lifting system 24 then picks one or more sheets 13 from the support frame 12 and a feeding system 26 feeds the lifted sheet(s) 13 forward in a longitudinal position. Operators then rotate the sheet(s) 13 (e.g., approximately 90 degrees) and position(s) the sheet 13 on the positioning frame 16 (e.g., length-wise across the upper portion of the "T-shape" in a transverse position). The positioning frame 16 then raises the sheet(s) 13 to the roof and the bolting mechanisms 18 bolt the sheet(s) 13 to the mine roof.

As illustrated in FIG. 1, the machine 10 also includes mining mechanisms 20, such as a cutterhead 22. Although the support frame 12, the installation apparatus 15, the lifting and feeding systems 24 and 26, and the mining mechanisms 20 are illustrated as part of the same machine 10 in FIG. 1, such that bolting and mining can be performed in parallel, it should be understood that the mining mechanisms 20 can be included in a separate piece of machinery. For example, in some embodiments, the support frame 12, installation apparatus 15, and the lifting and feeding systems 24 and 26 can be included as a piece of machinery for installing roof support sheets 13, and the mining mechanisms 20 can be included in a separate piece of machinery for mining.

Figure 2C:
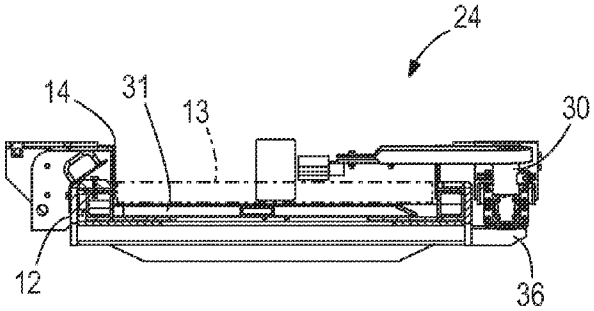
FIG. 2*c* is a cross-sectional view of the lifting system of FIG. 2*b* taken along line A-A.
Figure 2D:
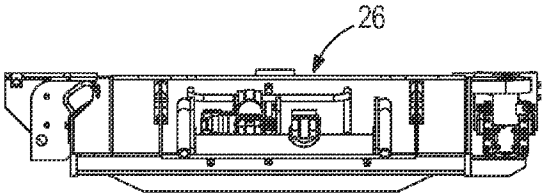
FIG. 2*d* is a cross-sectional view of the feeding system of FIG. 2*b* taken along line B-B.

FIGS. 2*c* and 2*d* are cross-sectional views of the lifting system 24 and the feeding system 26, respectively, according to one embodiment of the invention. As shown in FIG. 2*c*, the lifting system 24 includes a sheet starter 30. The sheet starter 30 is used to pick up a sheet 13 from the support frame 12. As shown in FIG. 2*c*, in some embodiments, the machine 10 can also include one or more sheet stack leveling pads 31 that keep the support frame 12 and the sheets 13 level while the sheet starter 30 lifts sheets 13 from the support frame 12.

Figure 3:
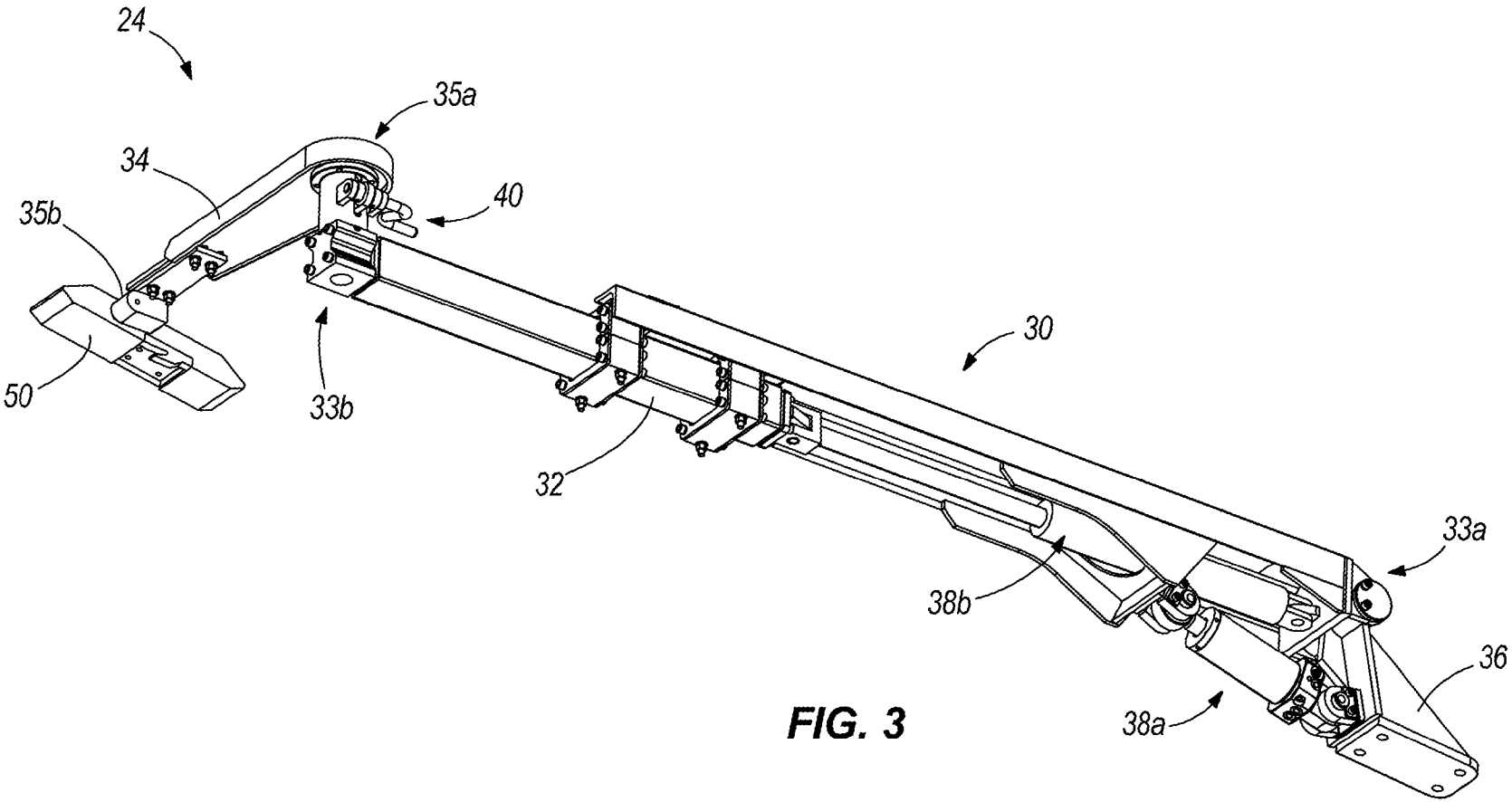
FIG. 3 is a perspective view of the lifting system of FIG. 2*a*.
Figure 4A:
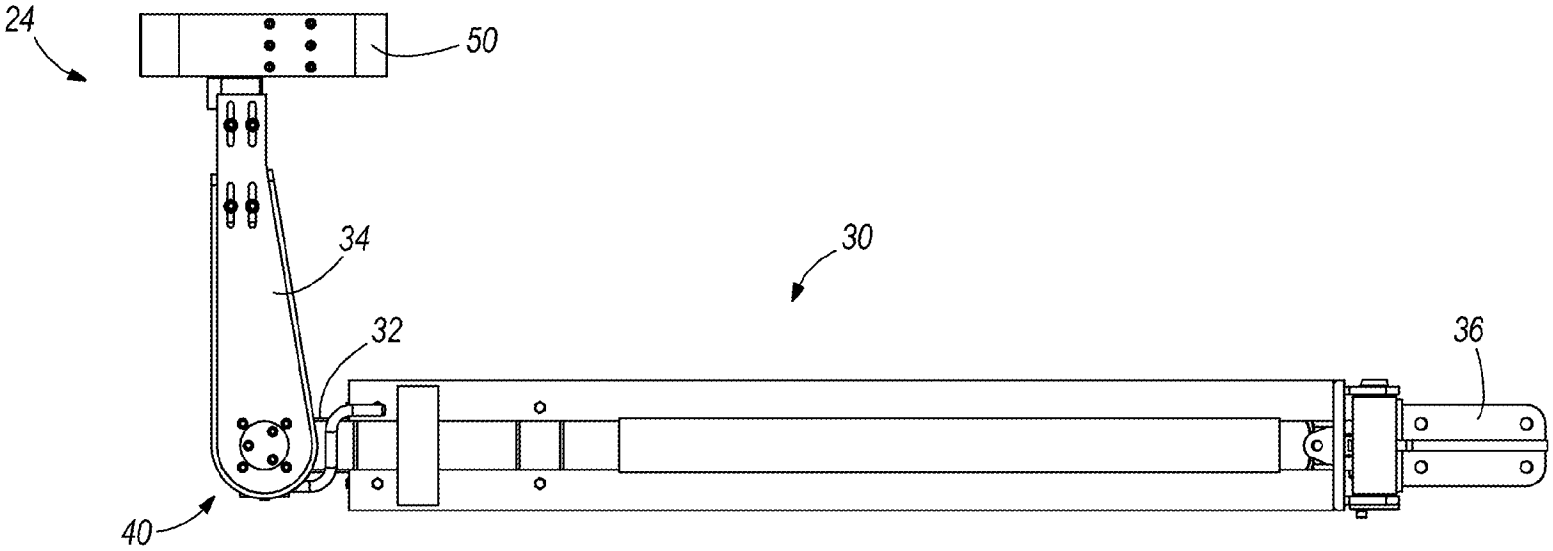
FIG. 4*a* is a top view of the lifting system of FIG. 2*a*.
Figure 4B:
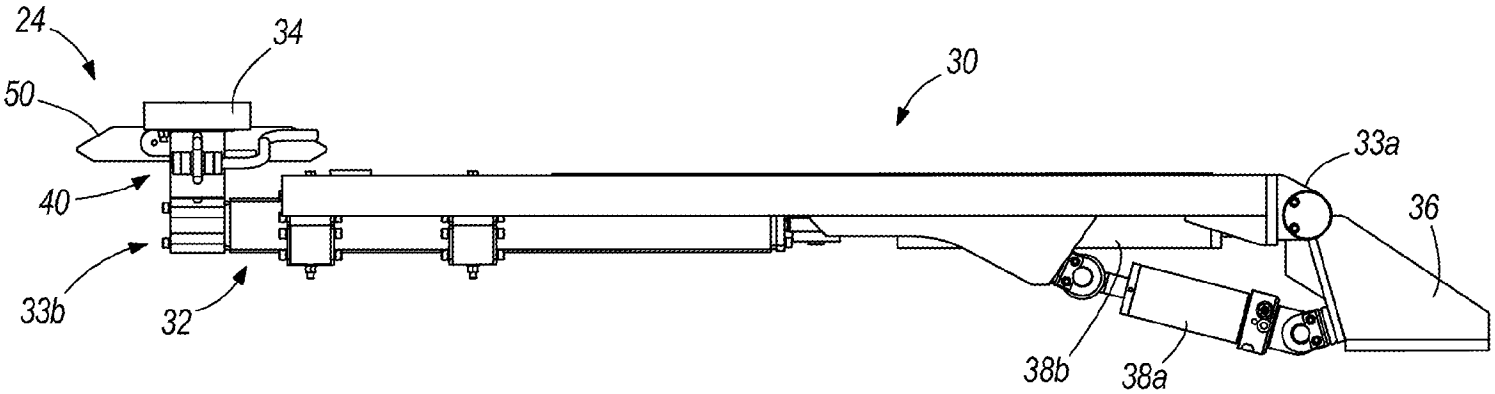
FIG. 4*b* is a side view of the lifting system of FIG. 2*a* in a raised and extended position.

FIGS. 3 and 4*a* illustrate the lifting system 24 in more detail. As shown in FIG. 3, the lifting system 24 includes the sheet starter 30, which includes a first arm 32 having a first end 33*a* and second end 33*b* and a second arm 34 having a first end 35*a* and a second end 35*b*. The end 33*a* of the arm 32 includes a bracket 36 that mounts the sheet starter 30 to the machine 10. As shown in FIG. 3, the arm 32 can include one or more hydraulic systems 38 (e.g., hydraulic cylinders) that allow the arm 32 to be moved. In particular, a first hydraulic system 38*a* can be used to pivot the arm 32 away from and toward a top of the machine 10 (e.g., vertically above where the sheets 13 are positioned), and a second hydraulic system 38*b* can be used to move the arm 32 along the length of the machine 10 (e.g., laterally along the length of the sheets 13), such as by extending the length of the arm 32. For example, FIG. 4*b* illustrates the lifting system 24 with the arm 32 in a fully raised and extended position. Also, in some embodiments, the hydraulic systems 38*a*, 38*b* (or a separate system) also moves the arm 32 horizontally.

The end 33*b* of the arm 32 is coupled to the end 35*a* of the arm 34. As shown in FIG. 3, in some embodiments, the arm 34 is positioned approximately perpendicular to the arm 32. Various mechanical couplings 40 can be used to couple the arm 32 to the arm 34, and, in some embodiments, the couplings 40 can allow the arm 34 to move relative to the arm 32. For example, the arm 34 can be coupled to the arm 32 such that it can be pivoted relative to the arm 32.

Figure 5:
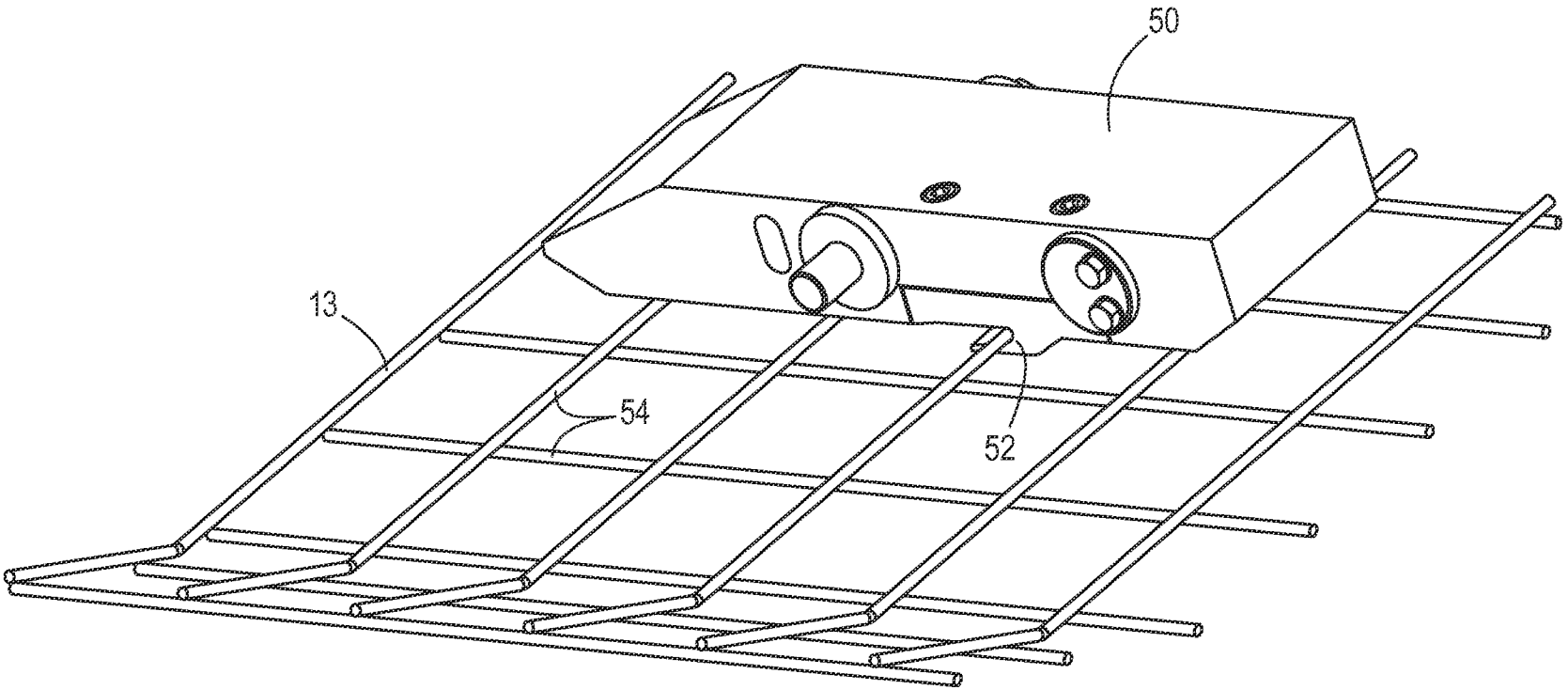
FIG. 5 is a perspective view of a shoe included in the lifting system of FIG. 2*a* according to one embodiment of the invention.

A pick-up shoe 50 is coupled to the end 35*b* of the arm 34. FIG. 5 illustrates the shoe 50 according to one embodiment of the invention in more detail. As shown in FIG. 5, the shoe 50 includes a tooth or hook 52 that engages with a sheet 13. For example, as shown in FIG. 5, the sheet of 13 can be constructed from perpendicular grids of wires 54, and the size and shape of the tooth 52 can be configured to engage with a wire 54 or a joint between two or more wires 54 when the shoe 50 is moved across the surface of the sheet 13. With the tooth 52 engaged with the wire 54, the arms 32 and 34 can move the shoe 50 to pick up the sheet 13. Therefore, in one embodiment, the tooth 52 engages with the sheet 13 without requiring hydraulics to operate and position the tooth 52 (i.e., separate from the arms 32 and 34), which makes the lifting system 24 more reliable, efficient, and cost-effective.

As described above, the hydraulic systems 38 can be used to position the shoe 50 over the top sheet 13 (e.g., horizontally and vertically) in the support frame 12 or pod 14 and move the shoe 50 to engage the tooth 52 with the top sheet 13. When the tooth 52 is engaged with the wire 54 of the sheet 13, the hydraulic systems 38 can then be used to lift the sheet 13 and feed the sheet 13 to the feeding system 26. In addition, when the lifting system 24 is not being used, the hydraulic systems 38 can be used to position the lifting system 24 to minimize the clearance height of the machine 10 and make the machine 10 more compact.

Figure 6C:
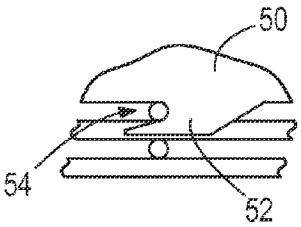
FIGS. 6*a* through 6*e* illustrate the shoe of FIG. 5 lifting a roof support sheet according to one embodiment of the invention.
Figure 6B:
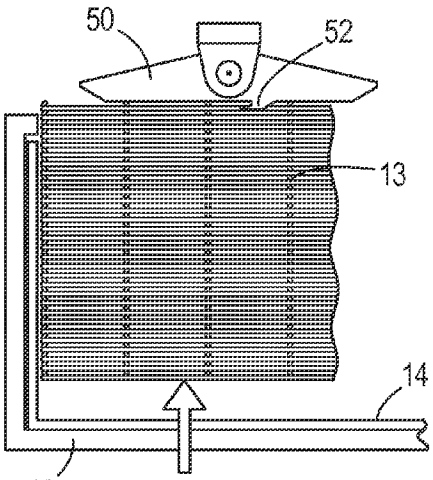
Figure 6A:
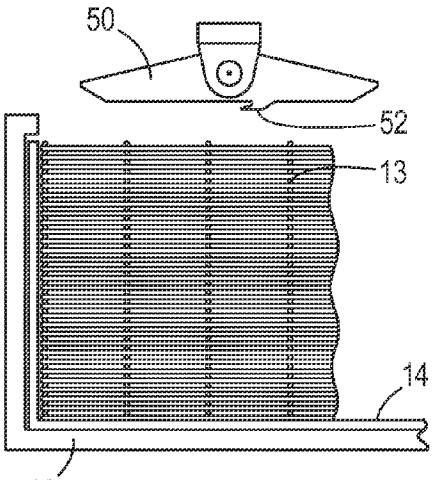
Figure 6E:
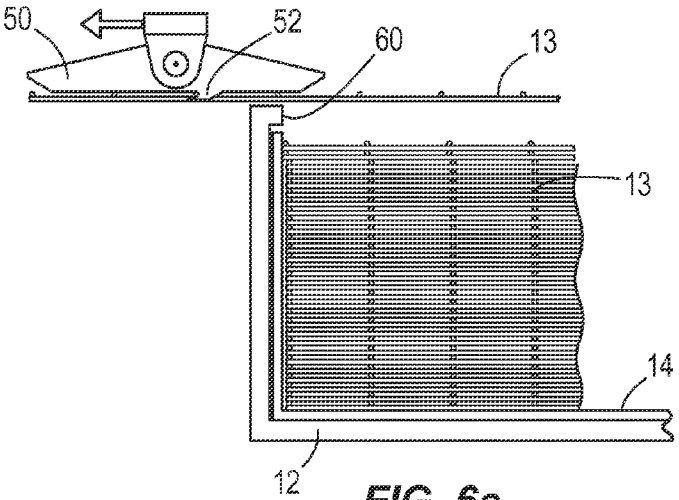
Figure 6D:
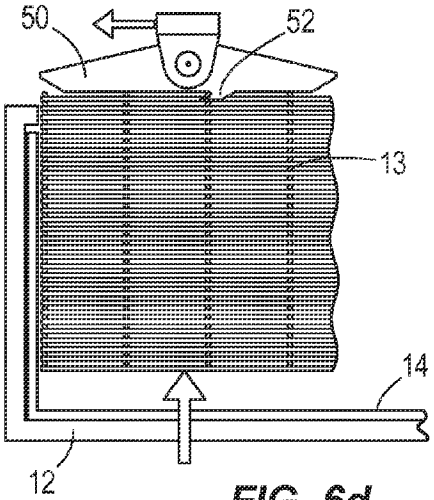

Optionally, in some embodiments, the support frame 12 can also be moved to position a sheet 13 under the shoe 50. For example, FIGS. 6*a* through 6*e* illustrate a shoe 50 lifting a sheet 13 according to one embodiment of the invention. As shown in FIG. 6*a*, the shoe 50 can be positioned over the support frame 12, which contains a pod 14 including a stack of sheets 13, at a fixed height relative to the support frame 12. The bottom end of the stack of sheets 13 can then be pushed upward (e.g., using a hydraulic system) relative to the pod 14 and the support frame 12 until the top sheet 13 in the stack engages with the tooth 52 on the shoe 50 (see FIG. 6*b*). Therefore, because the entire stack of sheets 13 is lifted, the pick-up shoe 50 has little or no need for vertical travel, which reduces the complexity of the hydraulic systems 38. For example, FIG. 6*c* illustrates the top sheet 13 of the stack engaged with the tooth 52 of the shoe 50. With the tooth 52 engaged with the top sheet 13 of the stack, the shoe 50 can be moved forward (e.g., horizontally) to remove the top sheet 13 from the stack and move the top sheet 13 toward the feeding system 26 (see FIG. 6*d*). In some embodiments, as shown in FIG. 6*e*, the support frame 12 includes an end stop 60 that prevents sheets other than the top sheet engaged with the tooth 52 from being moved when the shoe 50 moves. As also shown in FIG. 6*e*, when the top sheet has been removed from the stack, the stack can be lowered and made ready for the next cycle or can maintain its raised position.

Figure 7A:
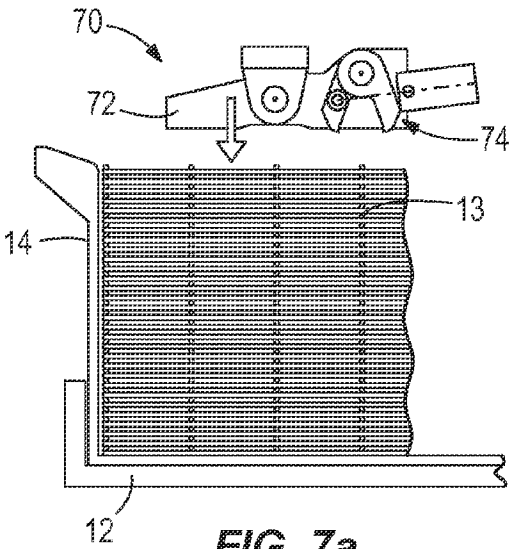
FIGS. 7*a* through 7*e* illustrate a gripper arrangement included in the lifting system of FIG. 2*a* lifting a roof support sheet according to one embodiment of the invention.
Figure 7B:
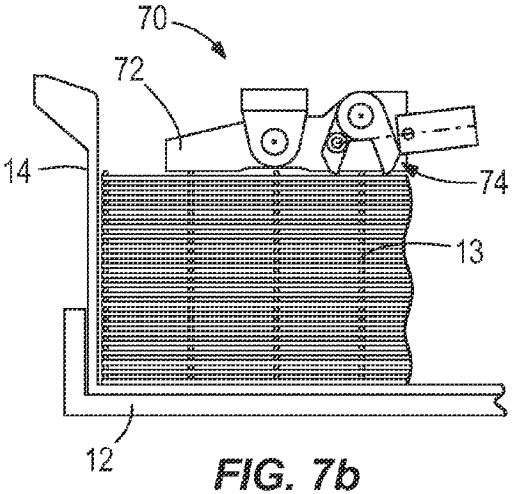
Figure 7C:
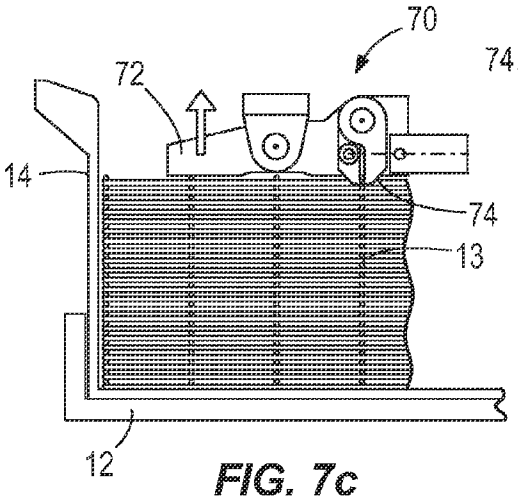
Figure 7D:
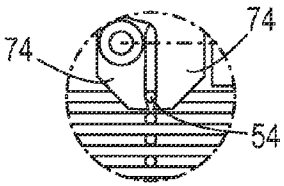
Figure 7E:
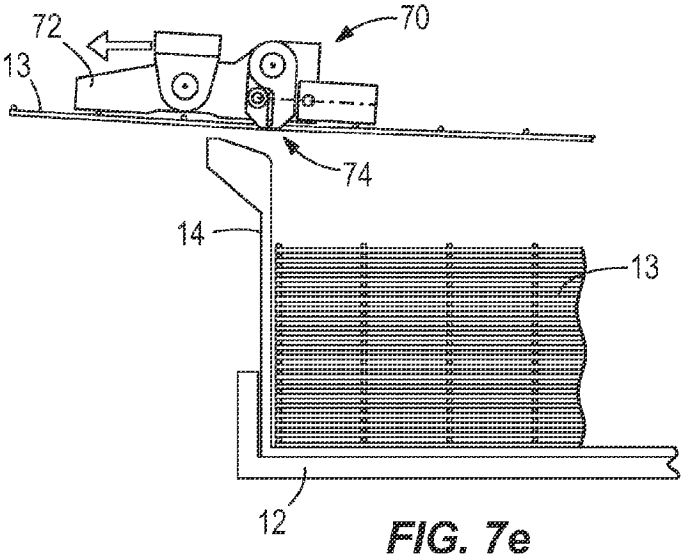

Alternatively, the lifting system 24 can include a gripper arrangement to pick up a sheet 13 from the support frame 12 and move the sheet 13 toward the feeding system 26. For example, FIGS. 7*a* through 7*e* illustrate a gripper arrangement 70 according to one embodiment of the invention. As shown in FIG. 7*a*, the gripper arrangement 70 includes a shoe 72 that includes pivoting jaws 74. The pivoting jaws 74 can be opened and closed (e.g., using an actuator) around a wire 54 or a joint between two or more wires 54 of a sheet 13. Therefore, as shown in FIGS. 7*a-b*, with the shoe 72 positioned (e.g., horizontally) over the top sheet 13 contained in the support frame 12, the shoe 72 can be lowered (e.g., vertically) such that the jaws 74 are positioned around a wire 54 of the sheet 13. The jaws 74 can then be closed to engage the wire 54, as shown in FIGS. 7*c* and 7*d*. Once the jaws 74 are engaged with the wire 54, the shoe 72 can be raised and moved forward (e.g., horizontally) to remove the top sheet 13 from the support frame 12 and move the sheet 13 toward the feeding system 26. In some embodiments, the hydraulic systems 38 described above for the shoe 50 can be used to move and position the shoe 72. However, because the jaws 74 are raised to clear the top sheet 13 before they are lowered around a wire 54, the hydraulic systems 38 may need to move the shoe 72 higher than shoe 50 with the tooth 52. Therefore, different hydraulic systems 38 or different control software, hardware, or mechanisms may be needed when the lifting system 24 includes the gripper arrangement 70. In some embodiments, the gripper arrangement 70 can also be used with a support frame 12 that can be moved as described above with respect to FIGS. 6*a* through 6*e*.

It should be understood that other configurations and constructions can be used to remove a sheet 13 from the support frame 12 and move the sheet 13 toward the feeding system 26. In particular, various combinations of moving the arms 32 and 34, the stack of sheets 13, and the support frame 12 can be used to remove a sheet 13. For example, in some embodiments, the support frame 12 (or the pod 14) can be moved to position a sheet 13 horizontally and/or vertically with respect to the lifting system 24. Also, various shapes and configurations of the shoes 50 and 72, the tooth 52, and the jaws 74 can be used to engage with a particular configuration of a sheet 13.

As described above, after the lifting system 24 engages a sheet 13, the lifting system 24 feeds the sheet 13 toward the installation apparatus 15 (e.g., the positioning frame 16). Also, in some embodiments, before reaching the installation apparatus 15, the feeding system 26 is used to convey the sheets 13 lifted by the lifting system 24. The feeding system 26 can include a drive assembly 75 and a support 76. As described below in more detail, the drive assembly 75 engages a sheet 13 (e.g., lifted by the lifting system 24) and moves the sheet 13 toward the installation apparatus 15 (e.g., the positioning frame 16). The support 76 can include a table, frame, or platform that supports the sheet 13 as the sheet is moved by the drive assembly 75 (e.g., before, during, and/or after the sheet 13 is conveyed by the drive assembly 75). Also, in some embodiments, the support 76 can be raised and lowered to disengage the sheet 13 from the drive assembly 75 after the drive assembly 75 has moved the sheet 13 and position the sheet 13 for installation.

Figure 8:
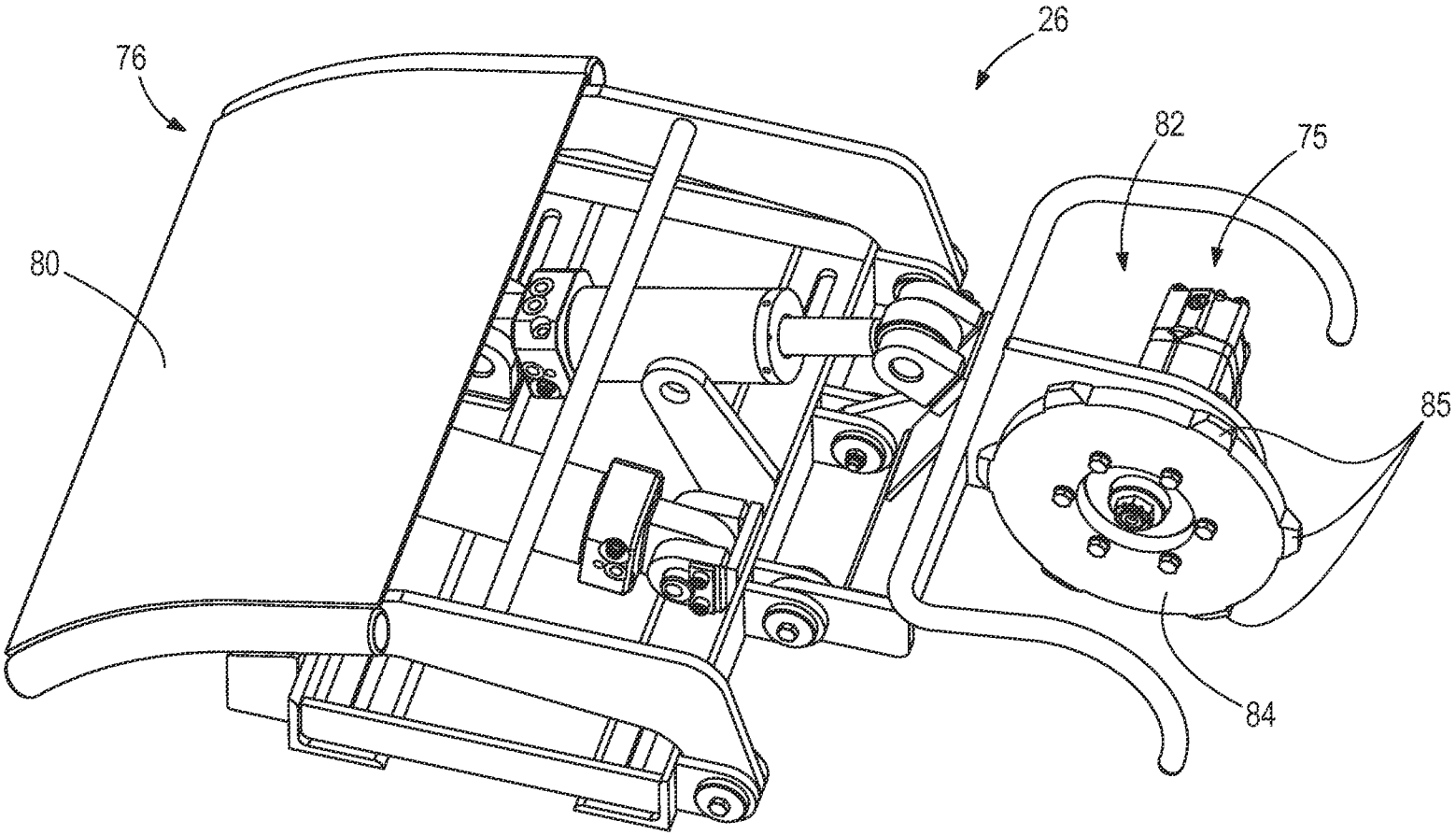
FIGS. 8 and 9*a* are perspective views of the feeding system of FIG. 2*a* according to one embodiment of the invention.
Figure 9A:
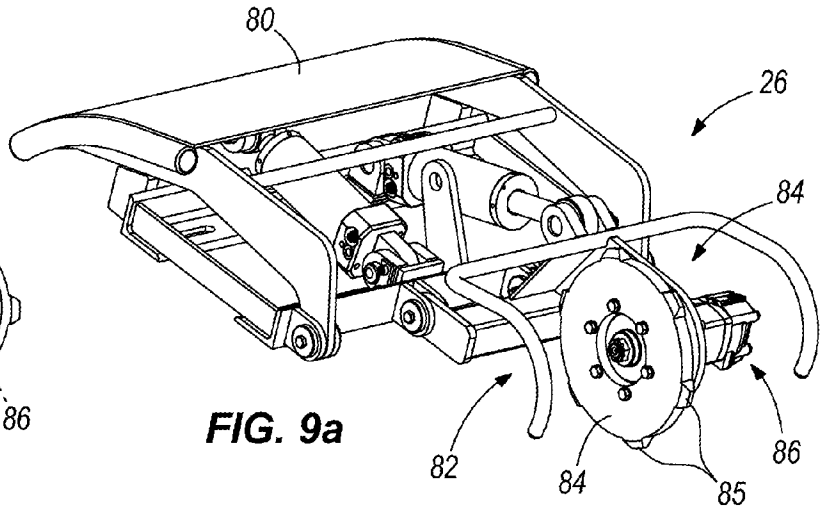

FIGS. 8 and 9*a* illustrate the feeding system 26 according to one embodiment of the invention. As shown in FIG. 8, the support 76 includes a table 80 and the drive assembly 75 includes a sprocket assembly 82. The sprocket assembly 82 includes one or more sprockets 84 that each includes teeth 85. In operation, the lifting system 24 lifts a sheet 13 and moves the sheet 13 forward to a point where the sheet 13 (e.g., a wire 54 or a joint between two or more wires 54) engages on one or more teeth 85 of the sprocket(s) 84. The sprocket(s) 84 are driven by a drive system 86. When the sprocket(s) 84 rotate, the sheet 13 is fed forward by the engaged teeth 85 until the sheet 13 reaches a specified position on the table 80 where the operators can rotate the sheet 13 and position the sheet 13 on the positioning frame 16. The teeth 85 can have various pitches depending on the pitch of the sheets 13. Also, different sprocket arrangements may be used. For example, a single sprocket arrangement, as shown in FIGS. 8 and 9*a-d*, may be used when the sheet 13 is adequately guided by the lifting system 24 and other components. As shown in FIGS. 10*a-e*, the single sprocket arrangement can include a sprocket 84 with nine teeth 85 that engage a sheet 13 with a pitch of approximately 100. As shown in FIGS. 9*a-d*, a sheet 13 is presented to the sprocket 84 by the lifting system 26 as the sprocket 84 is rotated clockwise. During this process, the teeth 85 engage with wires 54 of the sheet 13 and the rotating teeth 85 push the sheet 13 forward toward the table 80. In some embodiments, the sprocket 84 can be mounted on an arm that is movable (e.g., hydraulically raised and lowered) to help lift the sheet 13 clear of the stack on the support frame 12 and take the weight off of the sheet 13.

Figure 12:
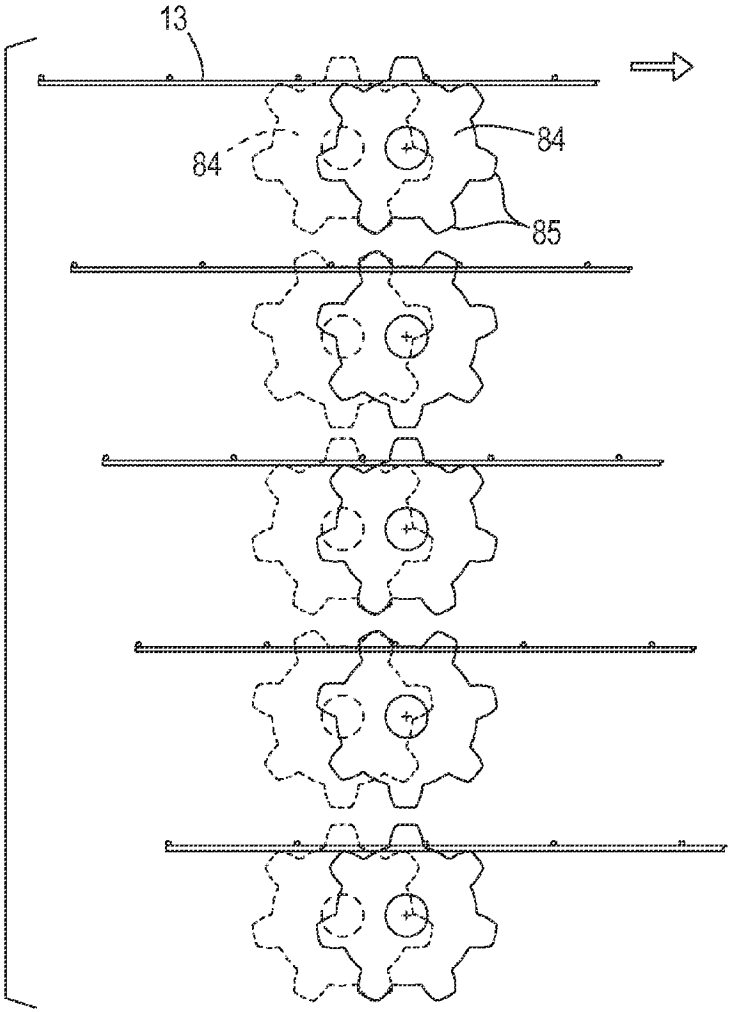
FIGS. 11 and 12 illustrate multiple sprocket arrangements for the feeding system of FIG. 2*a*.
Figure 11:
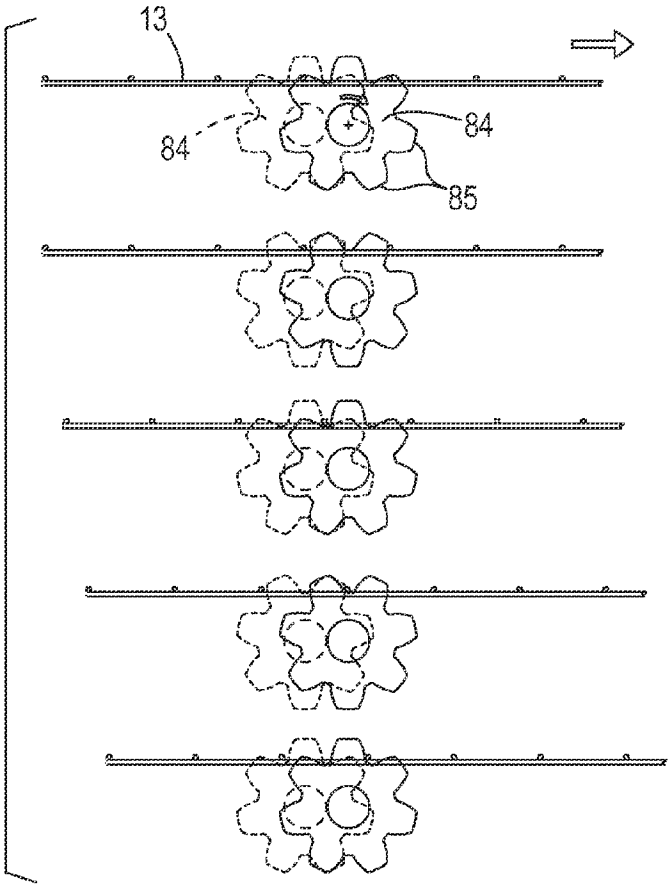

It should be understood that although a sprocket 84 with nine teeth 85 is illustrated in FIGS. 8-10, smaller sprockets and different shaped sprockets may be used. If smaller sprockets are used, however, the component of vertical force on the sprocket teeth may increase. This increased force can be compensated by using two or more staggered sprockets. Also, improved alignment may be achieved by using two or more sprockets 84 on different shafts or a common shaft, as shown in FIGS. 11 and 12. For example, the sprockets 84 illustrated in FIG. 11 have five teeth 85 and a pitch of approximately 50, which can be used to engage a sheet 13 with a pitch of approximately 150. Similarly, the sprockets 84 illustrated in FIG. 12 have seven teeth 85 and a pitch of approximately 75, which can be used to engage a sheet 13 with a pitch of approximately 150. In some embodiments, the sprockets 84 illustrated in FIGS. 11 and 12 are spaced approximately 300 millimeters apart. Using two or more sprockets can also be used to ensure that there is always at least one tooth engaged with the sheet 13 to keep the sheet 13 progressing.

Figure 9D:
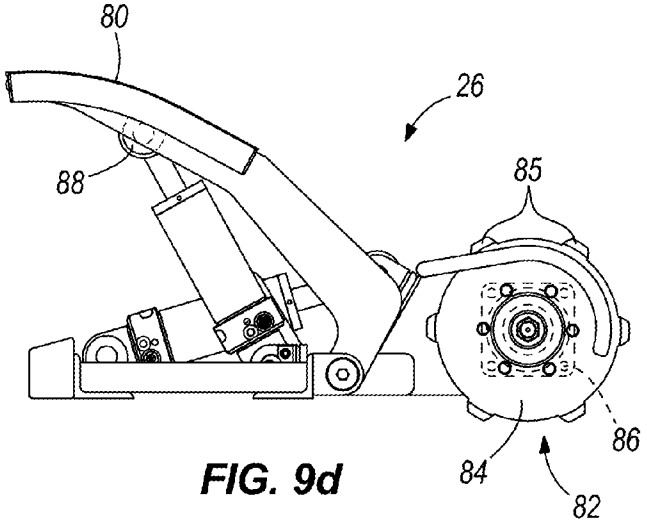
FIG. 9*d* is a side view of the feeding system of FIG. 8, with the table shown in an "up" position according to one embodiment of the invention.
Figure 9B:
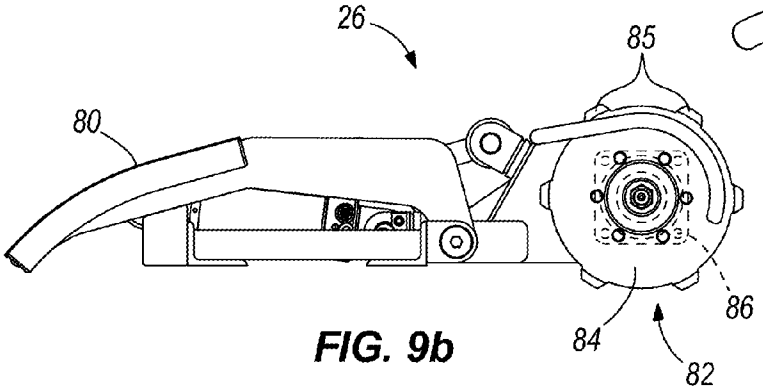
FIG. 9*b* is side view of the feeding system of FIG. 8 including a table and a sprocket assembly, with the table and the sprocket assembly shown in a "down" position according to one embodiment of the invention.
Figure 9C:
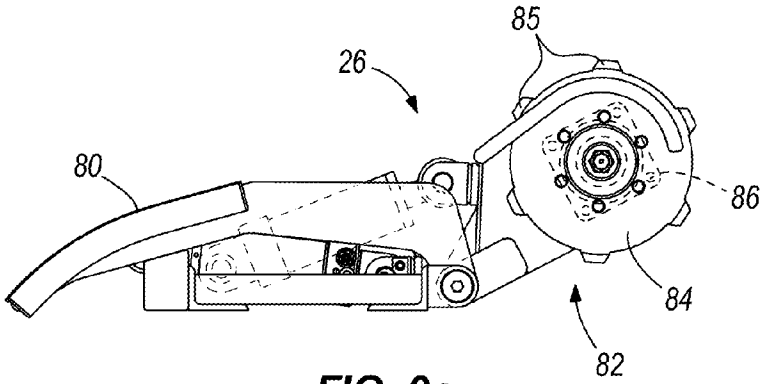
FIG. 9*c* is a side view of the feeding system of FIG. 8, with the sprocket assembly shown in an "up" position according to one embodiment of the invention.
Figure 10A:
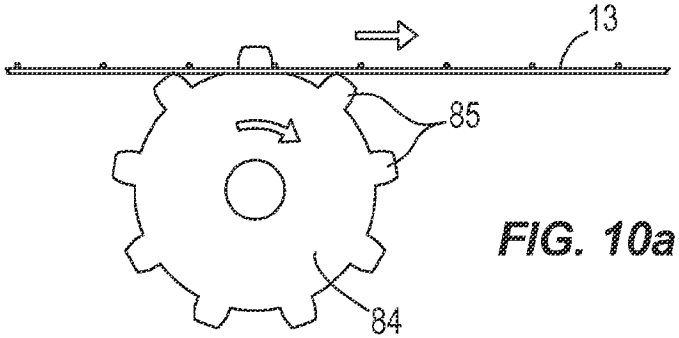
FIGS. 10*a* through 10*e* illustrate a single sprocket arrangement for the feeding system of FIG. 2*a*.
Figure 10B:
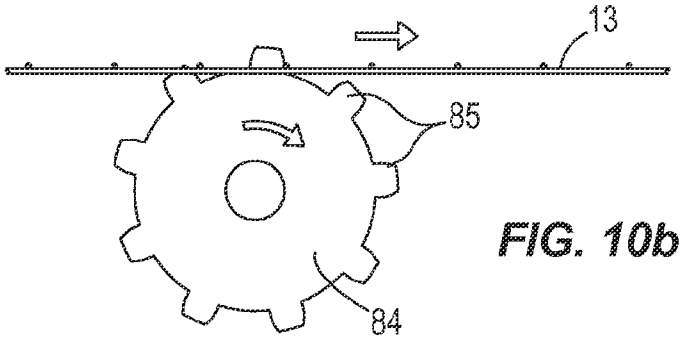
Figure 10C:
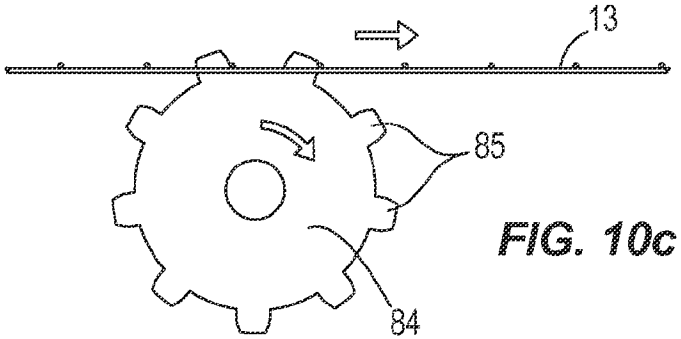
Figure 10D:
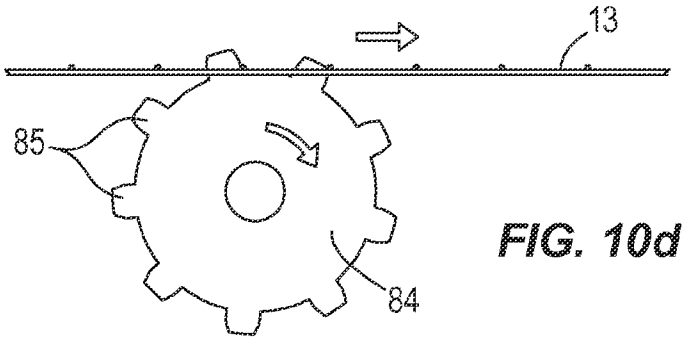
Figure 10E:
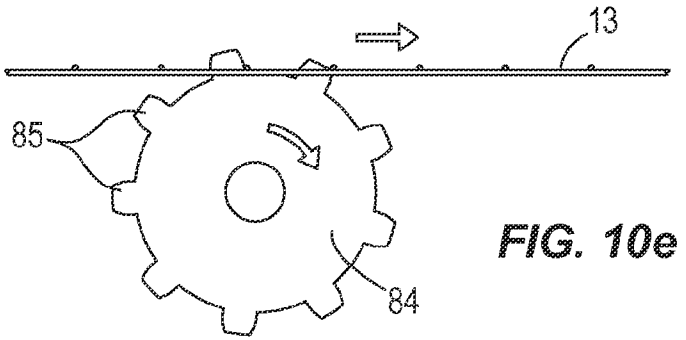

As noted above, the sprocket(s) 84 included in the sprocket assembly 82 can be driven or rotated by a drive system 86. As also noted above, a hydraulic actuator can be installed that raises and lowers the sprocket(s) 84 (or the entire assembly 82) to engage a sheet 13 with or disengage a sheet 13 from the sprocket(s) 84. For example, an actuator can raise the sprocket(s) 84 when the lifting system 24 feeds a sheet 13 to the feeding system 26 and can lower the sprocket(s) 84 to disengage the sprocket(s) 84 from the sheet 13 when the sheet 13 reaches the table 80 so that operators can position the sheet 13 for installation. FIG. 9*b* illustrates the sprocket(s) 84 lowered to a "down" position, and FIG. 9*c* illustrates the sprocket(s) 84 raised to an "up" position.

As described above, the table 80 supports a sheet 13 feed by the sprocket assembly 82 so that operators can move the sheet 13 into position for installation (e.g., rotated and placed on the positioning frame 16). As shown in FIGS. 9*b-d*, the table 80 can also include a drive or lift system 88. The lift system 88 can be used to raise or lower the table 80 to a "down" or "up" position or any appropriate level for operators to manually handle and position a sheet 13 (e.g., rotate and place on the positioning frame 16). In addition, the lift system 88 can be used to lower the table 80 as needed for clearance around the machine 10 (e.g., roof clearance) when the machine 10 is moving.

The ability to move the sprocket(s) 84 and the table 80 allows the feeding system 26 to be positioned in various positions. For example, as shown in FIG. 9*b*, when the table 80 and the sprocket(s) 84 are in a "down" position, the size of the feeding system 26 is minimized. Therefore, the position illustrated in FIG. 9*b* may be used when the feeding system 26 is not being used or when the size of the machine 10 needs to be minimized to allow the machine 10 to move in tight spaces. When the sprocket(s) 84 are in an "up" position and the table 80 is a "down" position, the feeding system 26 can be in a sheet-feeding position, as illustrated in FIG. 9*c*. In a sheet-feeding position, the sprocket(s) 84 can grab a sheet 13 lifted by the lifting system 24 and feed the sheet 13 to the table 80. Similarly, when the sprocket(s) 84 are in a "down" position and the table 80 is in an "up" position, the feeding system 26 can be in a sheet rotation position, as illustrated in FIG. 9*d*. In the sheet-rotation position, the sheet 13 is supported by the table 80 and is disengaged from the sprocket(s) 84, which allows an operator to rotate the sheet 13 and position the sheet 13 on the positioning frame 16.

Figure 13B:
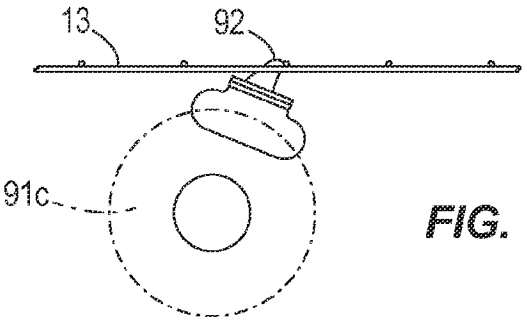
FIGS. 13-16 illustrate alternative feeding systems according to various embodiments of the invention.
Figure 13A:
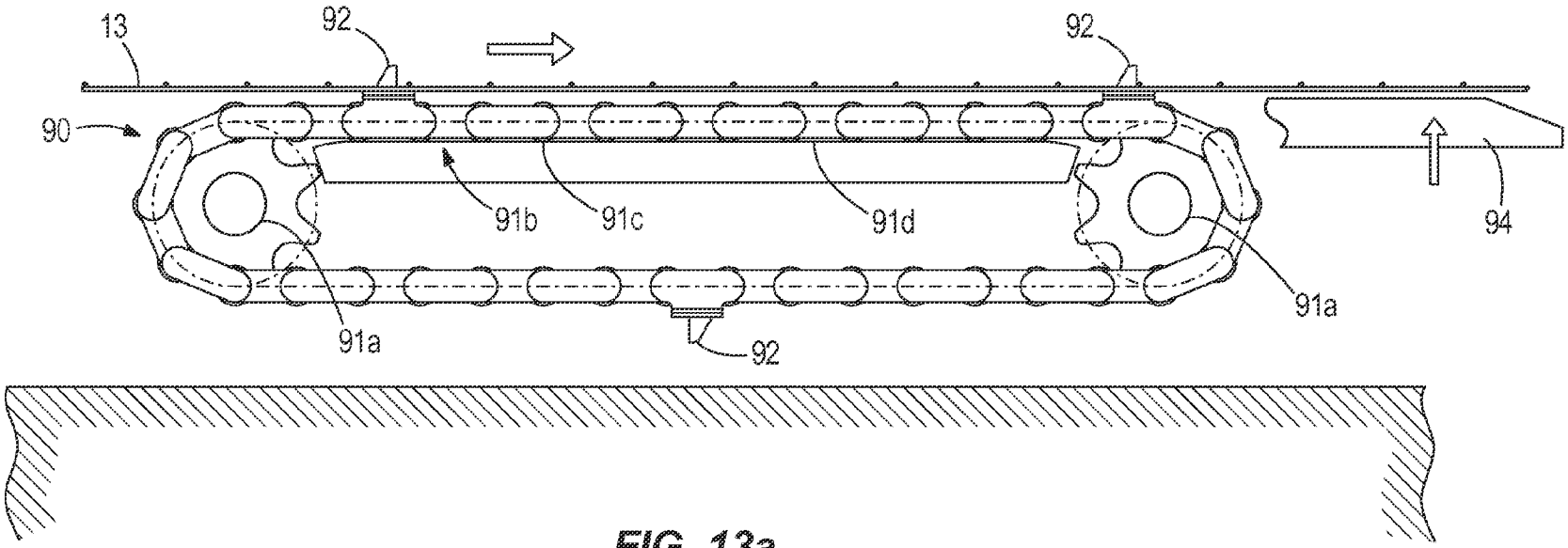

It should be understood that other configurations and constructions of the drive assembly 75 and the support 76 can be used to grab a sheet 13 from the lifting system 24 and convey the sheet 13 forward where operators can manipulate the sheet 13. For example, as illustrated in FIGS. 13*a* and 13*b*, the drive assembly 75 can include a chain drive 90. The chain drive 90 can include one or more sprockets 91*a* that support a conveyor chain 91*b* with rollers 91*c* running on a support track 91*d*. As shown in FIG. 13*a*, the sprocket(s) 91*a* can include eight teeth, which can be used for a conveyor chain 91*b* with a pitch of approximately 75 millimeters. Attached to the conveyor chain 91*b* are one or more teeth 92 that engage with wires 54 on a sheet 13 and push the sheet 13 forward toward the support 76, which includes a support frame 94. The support frame 94 can be hydraulically raised and lower to free the sheet 13 from the teeth 92.

Figure 14B:
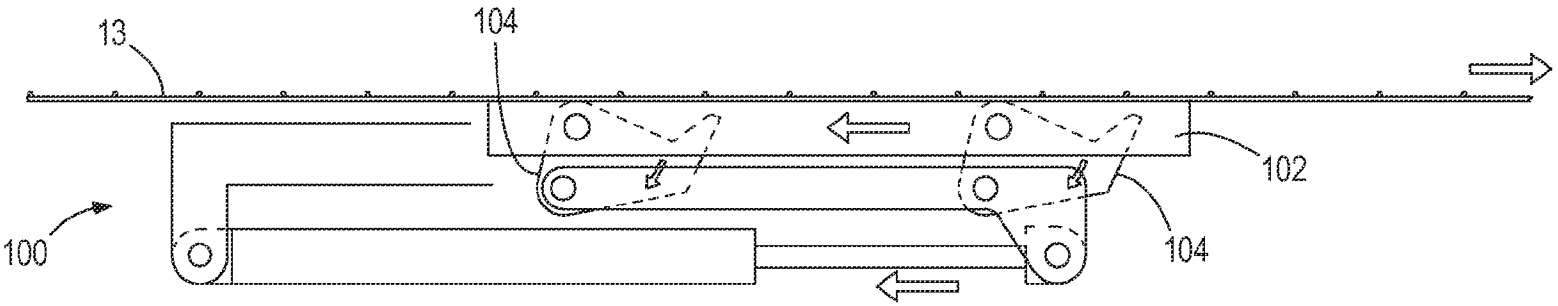
Figure 14A:
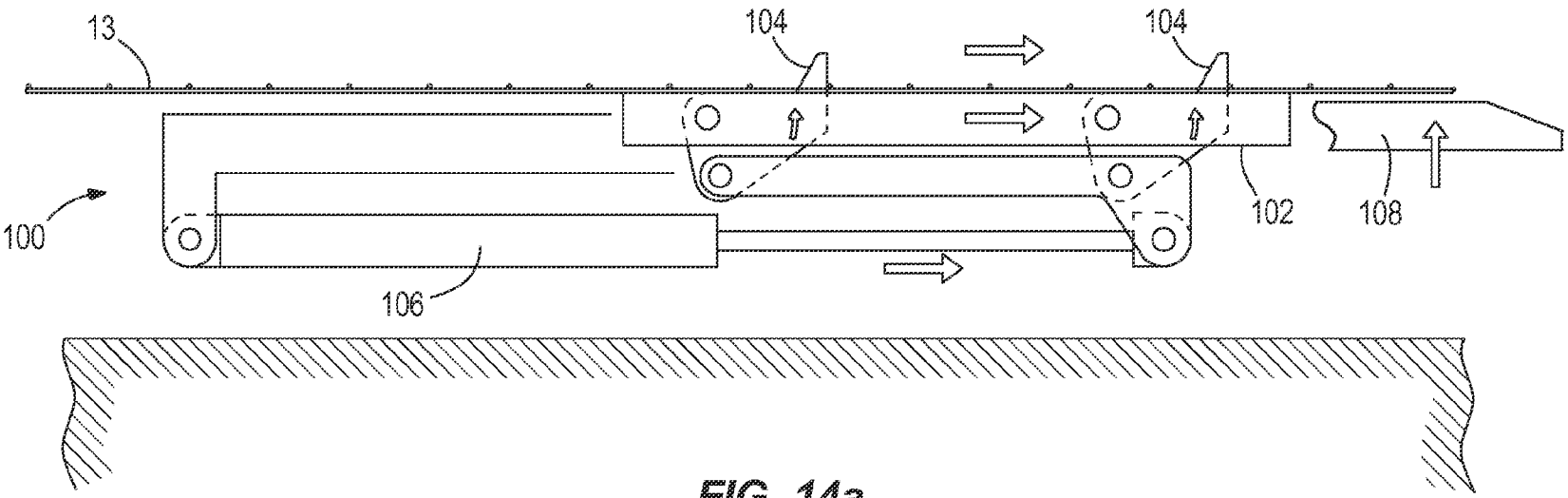

Similarly, as illustrated in FIGS. 14*a* and 14*b*, the drive assembly 75 can include a walking frame 100. The walking frame 100 can include an arm assembly 102 with one or more rotatable teeth 104. The arm assembly 102 can be driven by a hydraulic system 106 (e.g., a hydraulic cylinder) and can be positioned under the sheet 13. The teeth 104 can then be rotated upward to engage with wires 54 in the sheet 13. Once the teeth 104 are engaged, the arm assembly 102 can be driven forward, which also drives the sheet 13 forward. As shown in FIG. 14*b*, the teeth 104 can then be rotated downward to be disengaged from the sheet 13. With the teeth 104 disengaged, the arm assembly 102 can be moved in a return stroke opposite the direction of travel of the sheet 13 that positions the arm assembly 102 back at a starting position. At the starting position, the arm assembly 102 can then be re-engaged with the sheet 13 (or a new sheet 13) to move the sheet 13 through another forward motion. As illustrated in FIGS. 14*a* and 14*b*, the support 76 can include a support frame 108 that receives and supports sheets 13 fed forward by the walking frame 100, and, in some embodiments, the support from 108 can be hydraulically raised and lowered to free the sheet 13 from the teeth 104. As shown in FIG. 14*a*, in some embodiments, two walking frames 100 can be used, side-by-side. In this configuration, the walking frames 100 can work in alternate stroke directions, which provides continuous motion to the sheet 13.

Figure 15B:
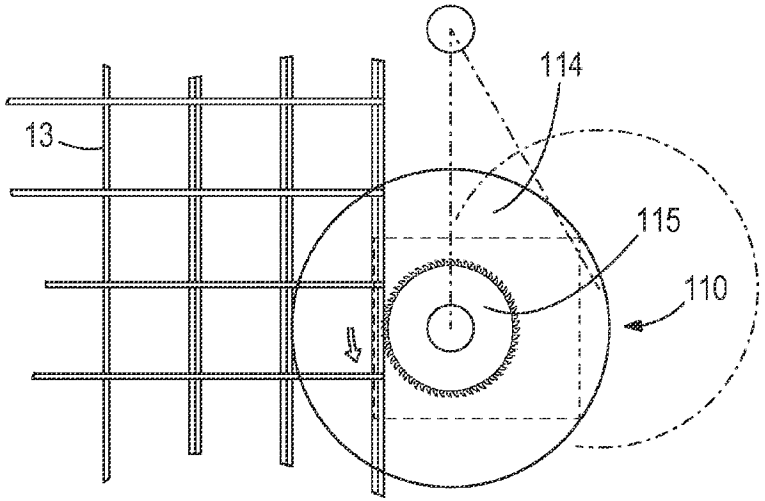
Figure 15A:
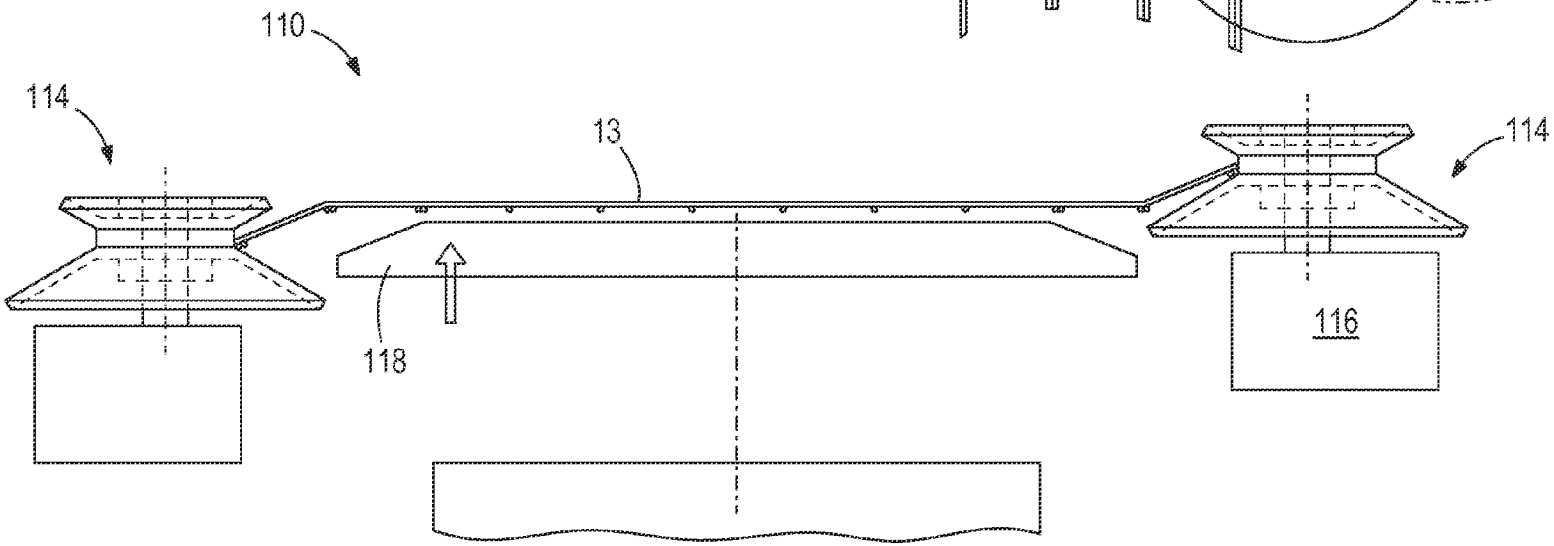

In addition, as illustrated in FIGS. 15*a* and 15*b*, the drive assembly 75 can include an edge drive 110. As shown in FIG. 15*b*, the edge drive 110 can include a plurality of rotating toothed wheels 114 that are driven by one or more drive systems 116 (e.g., a hydraulic motor). As shown in FIG. 5*b*, the wheels 114 include teeth 115 that engage with a side edge of a sheet 13. In some embodiments, the wheels 114 can be moved (e.g., pivoted) into and out of engagement with the edge of the sheet 13 (e.g., when a new sheet 13 is fed to the edge drive 110 or when a sheet is exiting the edge drive 110). As the wheels 114 are rotated, the sheet 13 is driven forward by the teeth 115 engaging with the side edge of the sheet 13. As illustrated in FIGS. 15*a* and 15*b*, the support 76 can include a support frame 118 that is positioned between the wheels 114 to support the sheet 13 as it is fed forward. In some embodiments, a wheel 114 can be positioned at each corner of the sheet 13. Therefore, a total of four wheels 114 can be used to convey a sheet 13 to a position where it can be manually handled and positioned by operators.

Figure 16B:
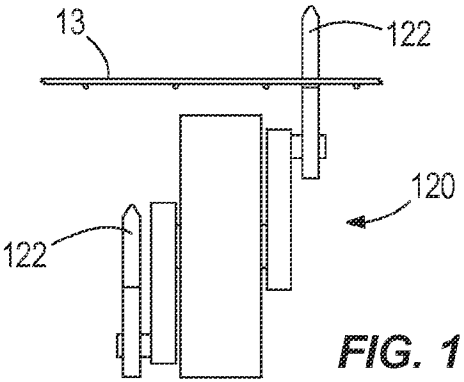
Figure 16A:
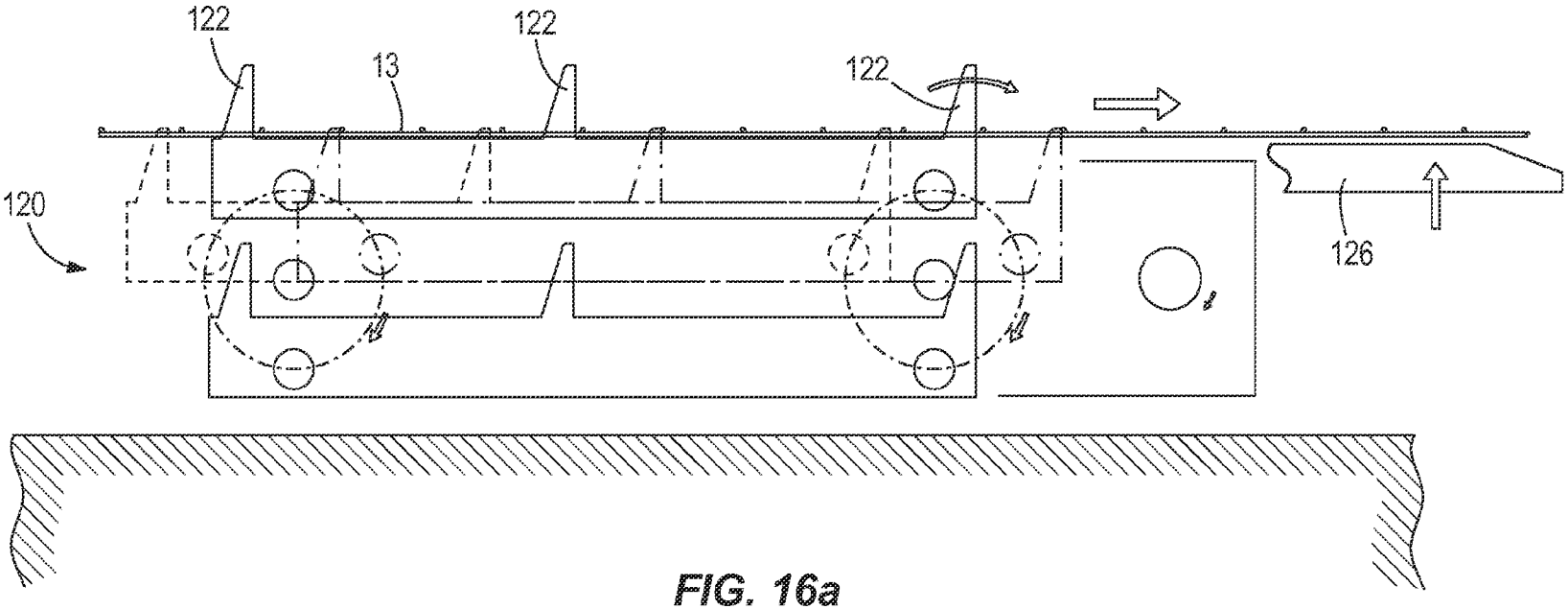

Furthermore, as illustrated in FIGS. 16*a* and 16*b*, the drive assembly 75 can include an oscillating beam 120. As shown in FIG. 16*b*, the oscillating beam 120 can include a plurality of teeth 122 (e.g., three teeth). Each end of the oscillating beam 120 can be coupled to a driving system (e.g., a hydraulic motor). The driving systems can rotate in sequence such that the oscillating beam 120 is rotated along a circular path under a sheet 13. Therefore, as the oscillating beam 120 is rotated forward, the teeth 122 are moved upward and into engagement with the sheet 13. Thereafter, when the oscillating beam 120 is driven forward through its rotation, the sheet 13 is also driven forward by the engaged teeth 122. When the oscillating beam 120 reaches the end of its forward rotation, the beam 120 is rotated down and away from the sheet 13, which disengages the teeth 122 from the sheet 13. After disengaging from the sheet 13, the oscillating beam 120 is driven backward (i.e., in a direction opposite the direction of travel of the sheet 13). After reaching the end of its backward rotation, the oscillating beam 120 is once again rotated upward where the teeth 122 re-engage with a new portion of a sheet 13 (or a new sheet 13) and subsequently advance the sheet 13 forward as the oscillating beam 120 is again rotated forward. As shown in FIG. 16*b*, the support 76 can include a support frame 126 that is positioned after the oscillating beam 120 to support the sheet 13 as it is feed forward. In some embodiments, the support frame 126 can be hydraulically raised and lowered to free a sheet 13 from the oscillating beam 120 and allow the sheet 13 to be manually moved by operators.

It should be understood that, in some embodiments, the lifting system 24 and/or the feeding system 26 can also rotate a sheet 13 so that the sheet 13 can be positioned on the positioning frame 16. Therefore, rather than requiring that one or more operator rotate the sheet after being handled by the lifting system 24 and the feeding system 26, the sheet 13 can be rotated by the lifting system 24, the feeding system 26, or a combination thereof. Furthermore, in general, the lifting system 24 and/or the feeding system 26 can be configured to rotate a sheet to any desired position based on the location and configuration of operators, the installation apparatus 15, the mine roof, or the machine 10.

Accordingly, embodiments of the invention provide robust and efficient methods and systems for lifting and conveying roof support sheets to be installed in a mine. Various features and advantages of the invention are set forth in the following claims.

What is claimed is:

1. A system for installing roof support sheets on a mine roof, the system comprising:

a support frame for holding a plurality of roof support sheets to be installed on a mine roof;

a lifting system for lifting at least one of the plurality of roof support sheets from the support frame; and a feeding system for obtaining the at least one of the plurality of roof support sheets from the lifting system and feeding the at least one of the plurality of roof support sheets toward an installation apparatus for installation on the mine roof.

2. The system of claim 1, wherein the plurality of roof support sheets includes steel mesh sheets.

3. The system of claim 1, wherein the lifting system includes at least one arm and a shoe.

4. The system of claim 3, wherein the shoe includes at least one tooth for engaging the at least one of the plurality of roof support sheets.

5. The system of claim 3, wherein the shoe includes a plurality of pivoting jaws for engaging the at least one of the plurality of roof support sheets.

6. The system of claim 3, wherein the at least one arm includes a first arm for moving the shoe at least one of horizontally, vertically, and laterally.

7. The system of claim 6, wherein the at least one arm includes a second arm coupled to the shoe and positioned approximately perpendicular to the first arm, the second arm pivotable with respect to the first arm.

8. The system of claim 3, further comprising at least one hydraulic system for moving the at least one arm.

9. The system of claim 3, wherein the support frame lifts the plurality of roof support sheets toward the shoe.

10. The system of claim 1, wherein the feeding system includes a drive assembly and a support, the drive assembly engaging the at least one roof support sheet and moving the at least one roof support sheet toward the installation apparatus and the support supporting the at least one roof support sheet moved by the drive assembly.

11. The system of claim 10, wherein the drive assembly includes a sprocket assembly including at least one sprocket that includes a plurality of teeth and a drive system for driving the sprocket assembly to engage the plurality of teeth of the at least one sprocket with the at least one of the plurality of roof support sheets and feed the at least one of the plurality of roof support sheets toward the support.

12. The system of claim 10, wherein the feeding system includes a hydraulic actuator for raising and lowering the drive assembly.

13. The system of claim 10, wherein the feeding system includes a lift system for raising and lowering the support.

14. The system of claim 10, wherein the drive assembly includes a chain drive including at least one sprocket supporting a conveyor chain with rollers running on a support track.

15. The system of claim 10, wherein the drive assembly includes at least one walking frame including an arm assembly driven by a hydraulic system and having at least one rotatable tooth.

16. The system of claim 10, wherein the drive assembly includes an edge drive including at least one pivotable toothed wheel rotated by a drive system, the at least one pivotable toothed wheel engaging a side edge of the at least one roof support sheet.

17. The system of claim 10, wherein the drive assembly includes an oscillating beam including a plurality of teeth rotated along a circular path under the at least one of the plurality of roof support sheets.

18. The system of claim 1, wherein the support frame, the lifting system, and the feeding system are mounted on a mining machine.

* * * * *